United States Patent [19]

Torre

[11] 4,104,848

[45] Aug. 8, 1978

[54] PACKAGING APPARATUS FOR PACKAGING ARTICLES OF DIFFERENT KINDS WITHIN A FILM OF A HEAT-SHRINKABLE PLASTIC MATERIAL

[76] Inventor: Francesco Torre, Via Bascheris, Dalmine, Bergamo, Italy

[21] Appl. No.: 768,319

[22] Filed: Feb. 14, 1977

[30] Foreign Application Priority Data

Mar. 3, 1976 [IT] Italy ..... 2913 A/76

[51] Int. Cl.[2] ..... B65B 53/02

[52] U.S. Cl. ..... 53/184 S

[58] Field of Search ..... 53/30 S, 182 R, 184 S, 53/390; 156/84, 85, 381; 219/385, 388 C

[56] References Cited

U.S. PATENT DOCUMENTS

| | | | |
|---|---|---|---|
| 3,047,991 | 8/1962 | Siegal et al. | 53/390 X |
| 3,354,605 | 11/1967 | Amberg et al. | 53/30 S |
| 3,422,596 | 1/1969 | Lyster et al. | 53/182 R |
| 3,550,354 | 12/1970 | Bate | 53/184 S |

*Primary Examiner*—Robert Louis Spruill

*Attorney, Agent, or Firm*—Beveridge, De Grandi, Kline & Lunsford

[57] ABSTRACT

A packaging apparatus for packaging articles in bags of a plastic film material, which film material shrinks onto the packaged article, comprising: a housing having control and heating members therein and provides a welding and retraction chamber, closed by a detachable cover of a transparent material, wherein welding blades are provided, and a heating box and a fan contained in said heating box; opening and closing of said detachable cover controlling the operation of the different apparatus members.

4 Claims, 5 Drawing Figures

PACKAGING APPARATUS FOR PACKAGING ARTICLES OF DIFFERENT KINDS WITHIN A FILM OF A HEAT-SHRINKABLE PLASTIC MATERIAL

The present invention pertains to a packaging apparatus for packaging articles of different kinds within a film of a hot-retractable plastic material.

This invention concerns a packaging apparatus for packaging products and articles of different kinds, such as foodstuffs, books or magazines and the like, within a film of a thermoretractable plastic material.

Apparatuses of this kind are well known and they substantially comprise a conveyor belt passing through a stove arranged downstream of a station for hotwelding the plastic film. At this station the plastic film is welded and the welded plastic film bag containing its article is brought into the stove by the conveyor belt for heat shrinking the plastic film onto the article, contained therewithin.

This procedure in two steps, i.e. welding the plastic film bag and heat shrinking the plastic film onto the article contained therewithin, beside the inherent drawback of involving two separate steps, which steps unduly increase the bulkiness and manufacturing cost of the apparatus, involves also the utilization of stoves, the side walls of which usually are not transparent and accordingly making it impossible to check the operation, observing the right shrinking point of the film onto the packaged article.

An object of the invention is to provide an apparatus of the kind set forth that allows both a continuous packaging operation, in mass production, and an irregular packaging operation, with a reduced encumbrance and a very small waste.

Another object of the invention is to provide such an apparatus wherein it is possible to check all the packaging operation by directly observing the same, thus avoiding the drawbacks of known apparatuses.

These objects are attained by a new and improved apparatus comprising: a housing receiving therewithin electric control means for controlling the heating and having a welding and shrinking chamber, which can be opened and closed by means of a detachable cover, preferably made of a transparent material; at least a heating box provided with electric resistance elements and a fan, both within the chamber; a plurality of welding blades provided on the upper sides of the chamber in the engaging area thereof with the cover; OFF-ON control means associated with the cover for connecting and disconnecting the heating elements upon opening and closing of the chamber through the detachable cover; a further control element associated with the cover for opening the heating box upon closing of the chamber by the cover, as well as adjustable means for feeding the heat-shrinkable plastic film.

The above objects as well as further objects, features, details and advantages of the invention, will become more apparent to those skilled in the art from the following detailed specification of an embodiment thereof, given for illustrative and not restrictive purposes, and to be considered together with the annexed drawings, wherein:

FIG. 1 a diagrammatic illustration of the apparatus with the cover opened;

Figure 1:
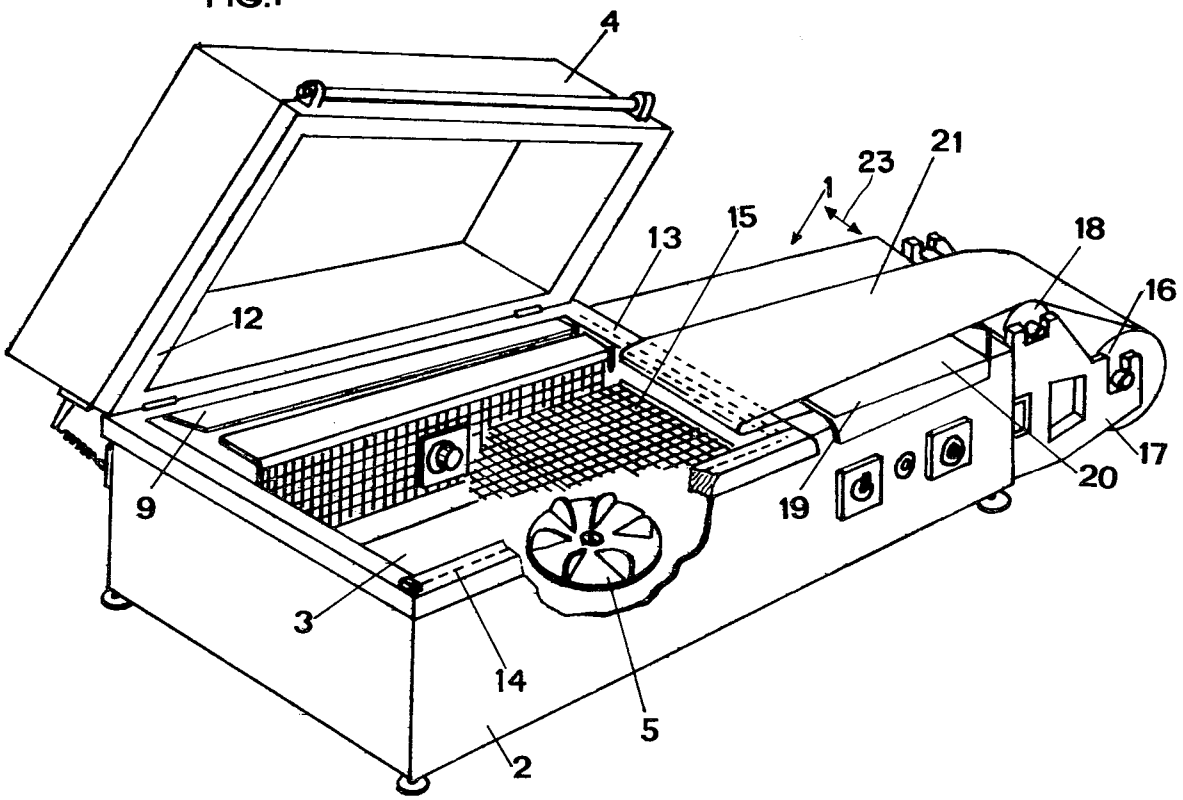
Figure 3:
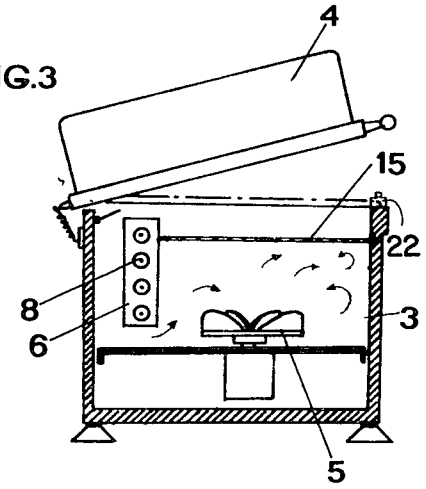
FIG. 3 shows a sectional illustration through the chamber and cover.
Figure 2:
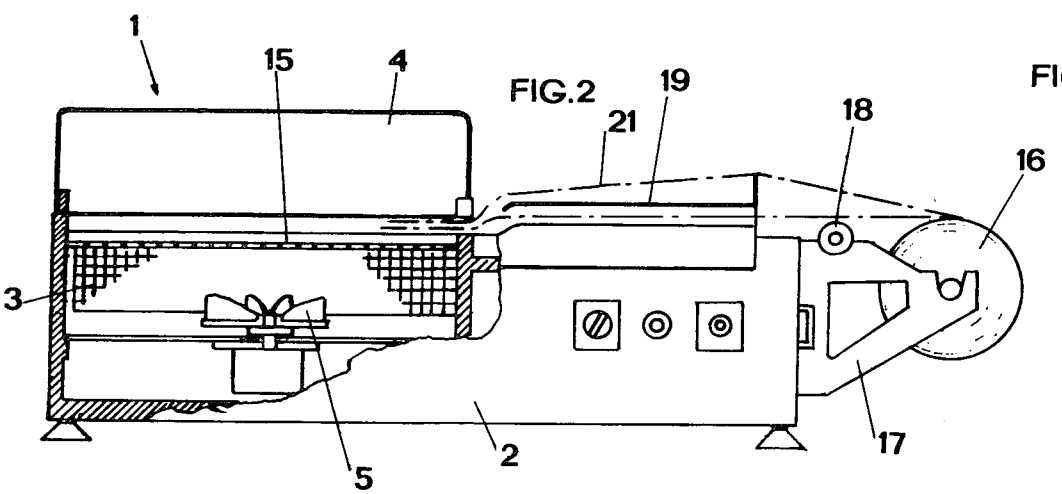
FIG. 2 shows a side, partially sectional illustration.
Figure 5:
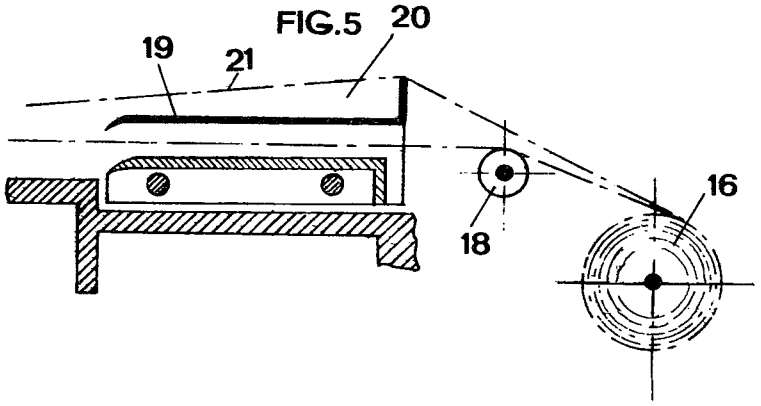
Figure 4:
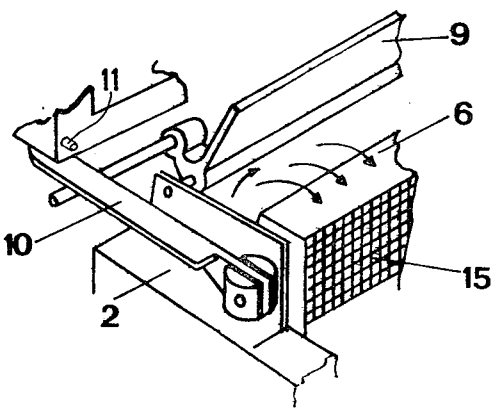

FIG. 4 diagrammatically illustrates a detail of the opening of the heating box; and FIG. 5 shows diagrammatically the film feeding means.

Referring now more particularly to the drawings, reference 1 generally indicates the apparatus of the invention, comprising a housing 2 within which a plurality of devices, such as timers, thermostats, as well as other circuit elements are received; these being of a conventional construction will not be more particularly described herein.

A chamber 3 is comprised within housing 2. Chamber 3 can be opened and closed by means of a movable cover 4, preferably made of a transparent material. A fan 5 is mounted within chamber 3, which fan operates to produce a swirling air movement during heating.

A heating box 6 is also provided within chamber 3, and includes electric resistances 8 and is closed by a hinged door 9.

A lever 10 (see FIG. 4) is provided to open and close door 9, and a stud 11 on base 12 of cover 4 acts on said lever when cover 4 is lowered onto chamber 3.

A plurality of welding blades are arranged on the upper face of chamber 3, at 13 and 14. The bearing plane on chamber 3 is a grate 15 that allows the air to circulate.

The members for feeding the plastic film are arranged on the other end of the apparatus and they comprise substantially a reel 16, appropriately supported by a support 17, from which reel the band of plastic film is unrolled, and the plastic film passes over a roller 18 and then over and below a working plane where the article to be packaged is placed in the position indicated by numeral 20, between working plane 19 and the upper portion of film 21.

Upon leaving plane 19 said article is then already contained between two film bands.

The film is then moved forward together with the article to be packaged onto grate 15, over chamber 3.

At this moment, closing of cover 4 causes a microswitch 22 to trip and apply the required control pulse to the electric elements of welding blades 13 and 14 and resistances 8 of heating box 6. Simultaneously, also fan 5 will be operated.

As a result, welding blades 13 and 14 will weld the film edges while resistances 8 are heating the air within heating box 6. Simultaneously, hinged door 9 has been opened by the stud 11 on cover base 12 and then hot air leaving box 6 is swirled by fan 5 and blown onto the package on grate 15, causing the film to shrink onto the article, in a very quick and uniform manner, since, due to the swirling movement of the air flow, all sides of said package are uniformly heated.

When, through transparent cover 4, the user has ascertained that the welded film bag has fully shrunk onto the article, he will raise cover 4 from chamber 3, thus causing the microswitch 22 to trip in the open condition, thereby stopping the heating operation of the elements concerned.

Moreover also door 9 of box 6 will close.

Obviously the invention is not restricted to the structural details here illustrated and described.

For instance cover 4 can be made of an opaque material and the right point of the film shrinkage can be watched through a suitable device externally arranged.

Furthermore the opening and closing operations for cover 4 as well as door 9 can be determined through other members than those disclosed herein.

Moreover, welding blades 13 and 14 can be omitted where it is preferred to weld the film bag in a different point as would be the case when applying the cover 4 and chamber 3 of the invention to already existing packaging apparatuses.

Moreover, means can be provided which allow the cover 4 to open and close automatically without any manual operations.

Furthermore means may be provided for automatically feeding the plastic film.

Finally, it should be noted that film-feeding members, namely support 17 and plane 19, can be arranged so that they can slide transversely, as indicated by arrow 23 to accomodate packaging of articles of different kinds with plastic film of different width.

Accordingly all additions and or modifications to the inventive concepts here disclosed must be considered within the invention scope.

I claim:

1. Apparatus for packaging articles within a film of heat-shrinkable plastic material comprising a housing; means within said housing defining a welding and shrinking chamber; a detachable cover for closing said chamber; means defining a heating box within said chamber; electrical resistance heating means within said heating box; at least one welding blade positioned in the area of said chamber engaged by said cover when said chamber is closed by said cover; a first control member responsive to closing and opening of said chamber by said cover for energizing and deenergizing said heating means; a second control member responsive to closing of said chamber by said cover for opening said heating box upon closing of said cover; and means for feeding heat-shrinkable film within said apparatus.

2. Apparatus as claimed in claim 1 in which said cover is made of a transparent material.

3. Apparatus as claimed in claim 1 in which said film feeding means is adjustable.

4. Apparatus as claimed in claim 3 in which said film feeding means is adjustable in a direction transverse the film feeding direction.

* * * * *